US005169025A

United States Patent [19]

Guo

[11] Patent Number: 5,169,025

[45] Date of Patent: Dec. 8, 1992

[54] THERMAL ISOLATING SHEATH FOR BEVERAGE CONTAINERS

[76] Inventor: I-Hong Guo, 3F., No. 31, Alley 82, Sec. 2, Guey-Yang Street, Taipei, Taiwan

[21] Appl. No.: 824,390

[22] Filed: Jan. 23, 1992

[51] Int. Cl.[5] ..... B65D 25/34

[52] U.S. Cl. ..... 220/739; 220/903; 215/100.5; 215/12.1

[58] Field of Search ..... 220/903, 739, DIG. 9, 220/62; 215/12.1, 12.2, 13.1, 100.5; 229/1.5 H; 150/901

[56] References Cited

U.S. PATENT DOCUMENTS

| | | | |
|---|---|---|---|
| 1,228,258 | 5/1917 | Sullivan | 220/903 |
| 1,917,953 | 7/1933 | Davis | 215/100.5 |
| 2,389,390 | 11/1945 | Silverman et al. | 215/12.1 |
| 3,110,407 | 11/1963 | Dahl | 215/12.1 |
| 3,379,335 | 4/1968 | Mongelluzzo | 220/62 |
| 3,589,971 | 6/1971 | Reed | 150/901 |
| 3,654,049 | 4/1972 | Ausnit | 220/903 |
| 4,197,890 | 4/1980 | Simko | 215/12.1 |
| 4,648,525 | 3/1987 | Henderson | 220/903 |
| 4,705,085 | 11/1987 | Brown | 220/903 |

*Primary Examiner*—Stephen Marcus
*Assistant Examiner*—S. Castellano
*Attorney, Agent, or Firm*—Bacon & Thomas

[57] ABSTRACT

A thermal isolating sheath for the beverage containers, which is integrally made by a kind of flexible and elastic thermal isolating material, and is comprised of a main gasket and a base gasket. The main gasket is of suitable width and length, which may be closed to form a cylindrical shape by two buttons on both side edges thereof. The base gasket extended integrally from the midpoint on one edge of the main gasket may be defined as the base of the sheath by snapping up together the individual buttons disposed respectively on the appropriately angularly extending corner tabs thereof and the two buttons disposed on the main gasket; thereby a sheet of gasket layer is defined which may cover the periphery of a beverage container.

1 Claim, 6 Drawing Sheets

THERMAL ISOLATING SHEATH FOR BEVERAGE CONTAINERS

BACKGROUND OF THE INVENTION

The invention relates to a sheath, and especially to a thermal isolating gasket device which may be laid out evenly, and also may cover the periphery of a container.

The beverage in a normal container such as a glass cup or an easy-opener ordinarily is not for drinking in normal temperature. For example, when hot tea is poured into a glass after infusion, it will be hard for a man to grasp tightly the high temperature glass; and either with tea or coffee, it will have the best smell in the first infusion, but the high temperature of the glass will make an uneasy drinking.

Further, cold beverage in a container such as canned soda or beer, will make the most comfortable feeling when it is drunk directly out from the refrigerator. But the cold water outside the container will wet the hand with uncomfortable feeling.

Normal house used pot put on the table with very high temperature soup or other foods with fluid is always detrimental to the table surface. Especially with glassy surface, the table will crack due the high temperature.

The present invention provides a thermal isolating sheath device, which doesn't have the disadvantages stated above.

SUMMARY OF THE PRESENT INVENTION

The present invention provides a thermal isolating sheath device, wherein a base gasket is provided being integrated to one edge of a main gasket with suitable width; there is a line of buttons on either side edge of the main gasket, said one edge provides with two buttons disposed separately at the two sides of the base gasket and in their appropriated positions, so as to match respectively the buttons disposed on the corner tabs extended from the base gasket and to snap up with each other to form the base; and the main gasket can be closed to form a cylindrical shape, so as to let a beverage container fit therein, which conveniently cover the periphery of the container as a thermal isolating gasket layer.

The novelty and the other characters of the present invention will be apparent in reading the specification of the drawings accompanied herein.

DETAILED DESCRIPTION OF THE PREFERRED EMBODIMENT

Figure 1:
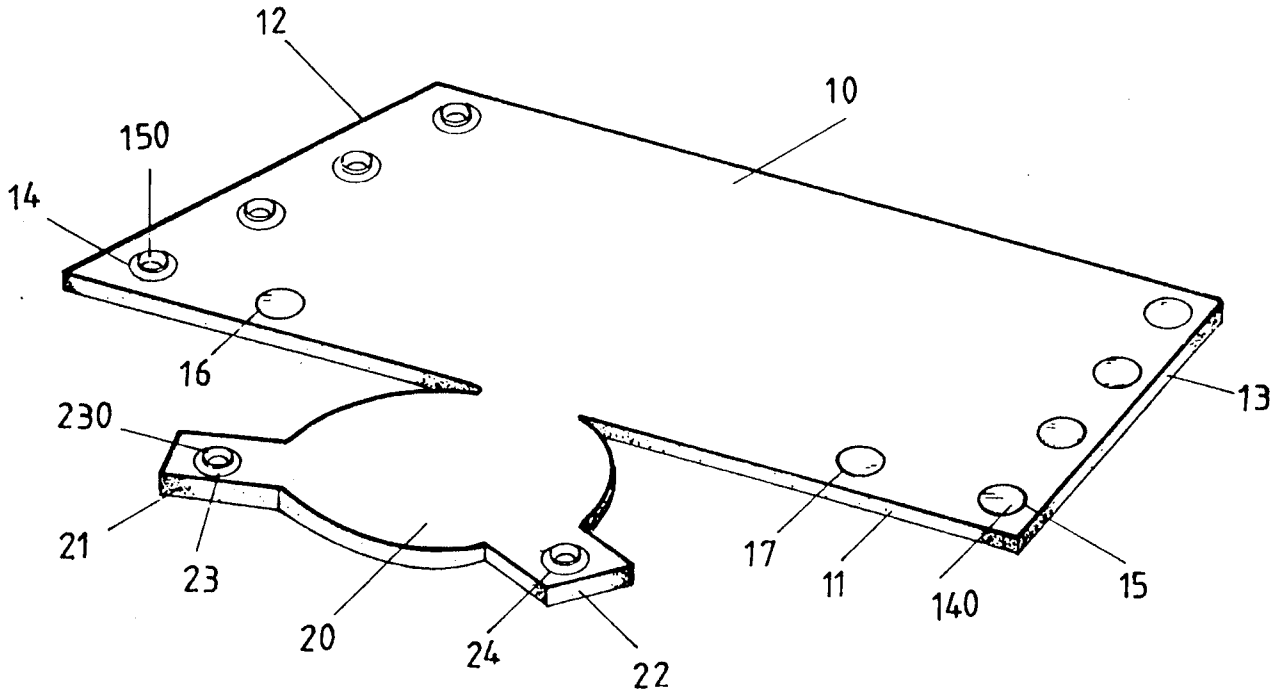
FIG. 1 is a perspective view of an embodiment of the present invention laid out evenly.

Referring to FIG. 1, the present invention is generally comprised of a main gasket 10 of suitable width and length, and a base gasket 20 integrally extended from an edge 11 of the main gasket 10, the whole sheath can be quickly made by a thermal isolating flexible elastic material.

In an appropriate distance respectively from the side edges 12, 13 thereof, the main gasket 10 has corresponding lines of buttons 14, 15. The buttons 14, 15 have their surface 140 and inner faces 150 in contrary disposing relation. On the main gasket 10 there are single buttons 16, 17 disposed separately at both sides of the base gasket 20, with the surfaces 160 of the buttons 16, 17 facing upwards, and the inner faces thereof (not shown) facing downwards.

Base gasket 20 is made in circular shape primarily, and extends integrally from the midpoint on one edge 11 of the main gasket 10. There are two corner tabs 21, 22 extending in suitable angles, having on said corner tabs 21, 22 buttons 23, 24 facing upwards, the backfaces 240 (FIG. 2) thereof facing downwards.

Figure 2:
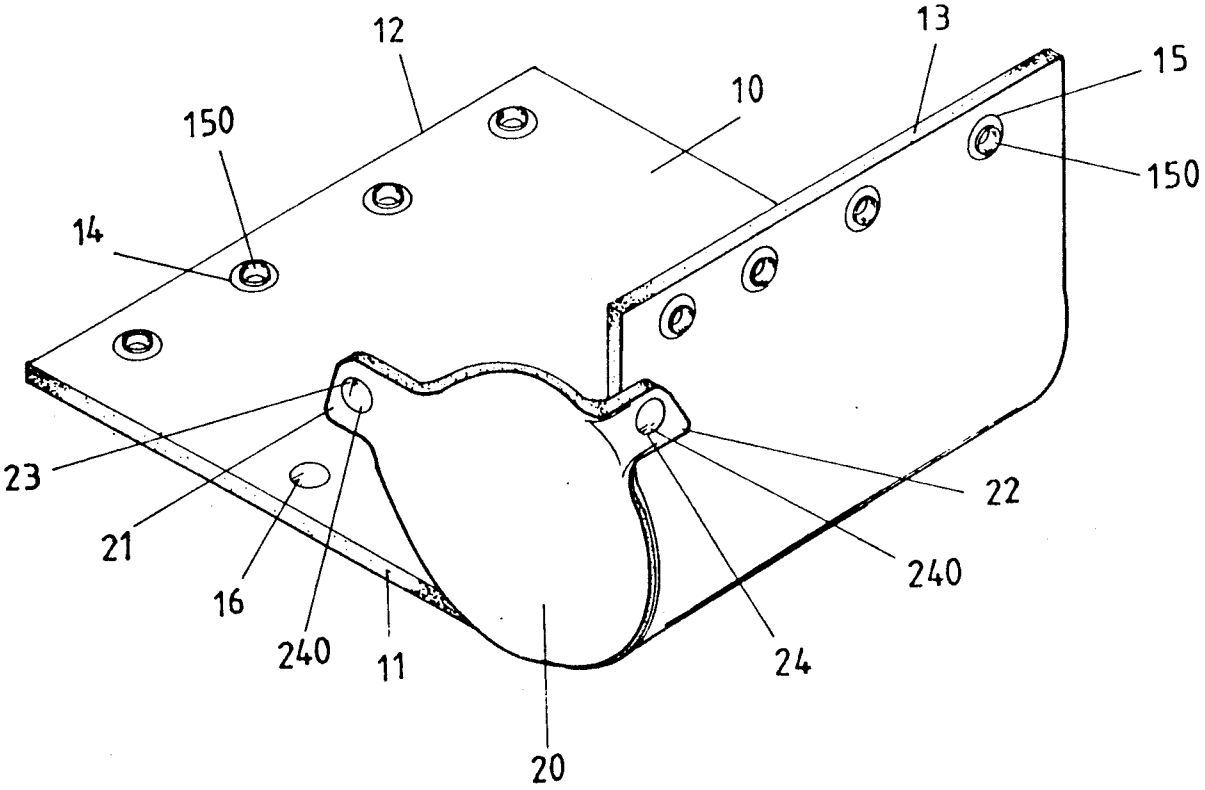
FIG. 2 shows the base gasket of the sheath in FIG. 1, wherein one corner tab has already been snapped up into the main gasket.
Figure 3:
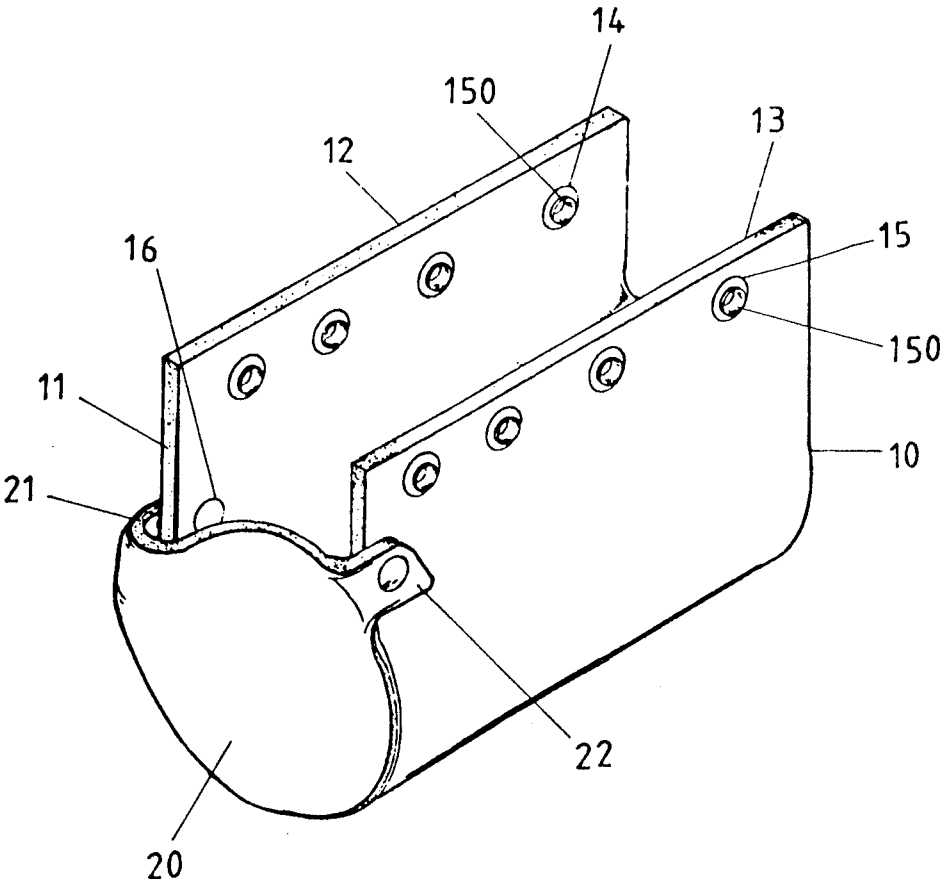
FIG. 3 shows that another corner tab has been snapped up into the main gasket.
Figure 4:
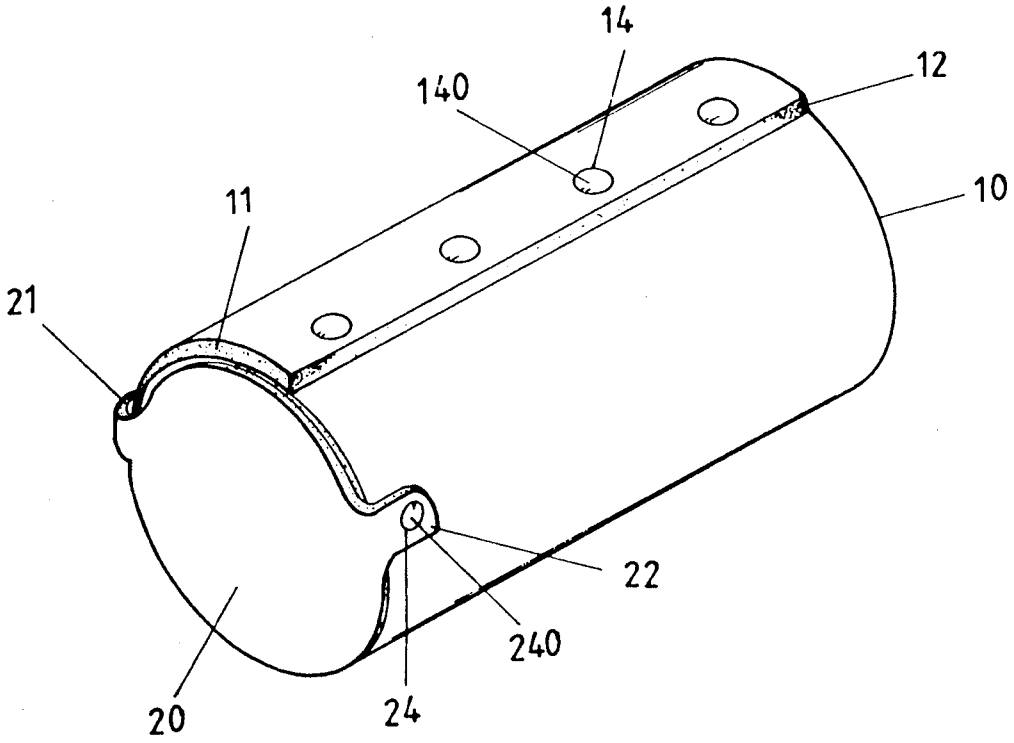
FIG. 4 shows that the main gasket is closed to form a cylindrical shape.

Referring to FIG. 2, 3, said inner faces 230 of the buttons 23, 24 on said corner tabs 21, 22 correspond to the inner faces of the buttons 16, 17 on the main gasket 10, they are adapted to snap up with each other to form a base. The whole main gasket 10 may be closed to form a cylindrical shape (e.g. FIG. 4); the two lines of buttons 14, 15 on the side edges thereof may have their inner faces 150 snapped up with each other.

Figure 5:
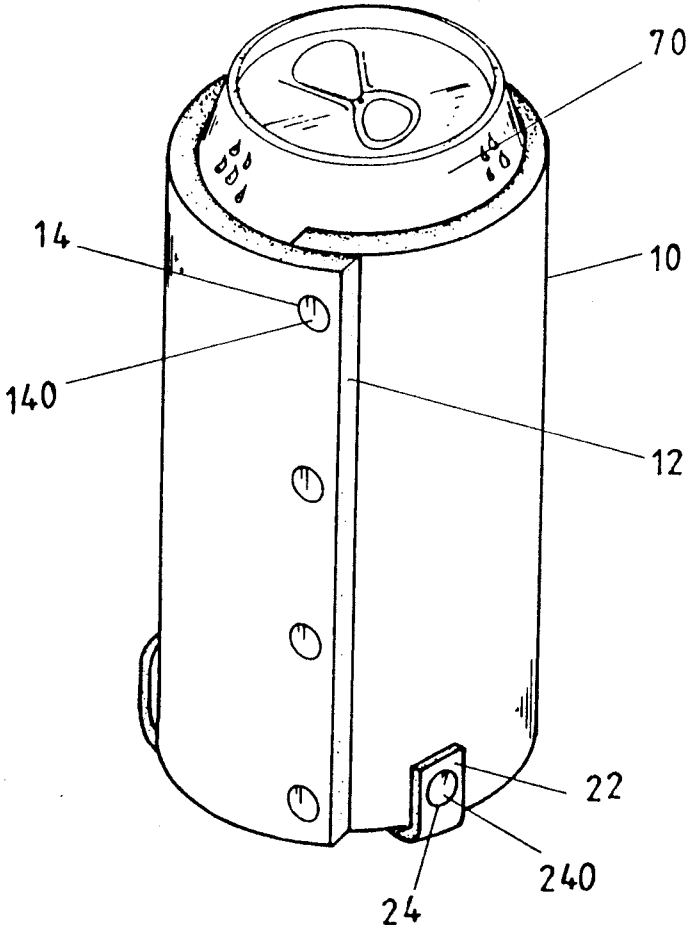
FIG. 5 shows the cylindrical sheath in FIG. 4, wherein a beverage container is fitted.

As shown in FIG. 5, the cylindrical sheath may have its inner hole allowed insertion of a beverage container 70. The whole sheath may cover the periphery of the beverage container 70 as a thermal isolating gasket layer, not only for thermal isolating, temperature maintaining, but also for the comfort of feeling in holding it.

Figure 6:
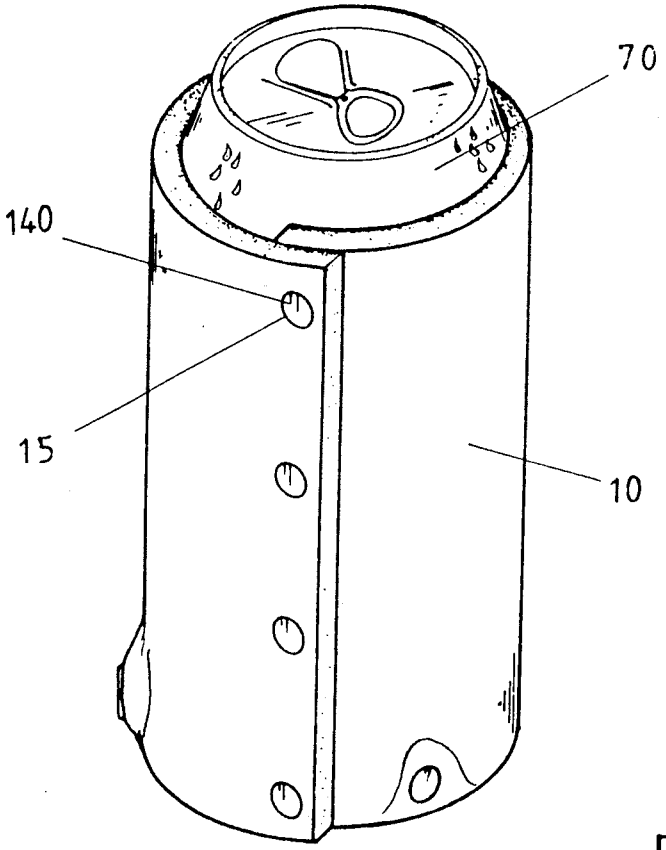
FIG. 6 shows a perspective view, wherein an inner surface of the main gasket lap over the outer surface thereof.

Referring to FIG. 6, due to the design of the sheet like sheath, both faces of which are adaptable for selectively covering the periphery of the beverage container. Therefor, the same sheath will have two different colors or patterns for use as different decorative package each time it covers the container.

Naturally, the whole sheath may be used as a thermal gasket for normal high temperature pots, tea cups etc. when it is laid out. (e.g. FIG. 1)

The integral gasket of the present invention may be quick made by integral moulding, with low cost. It is available in isolating the high temperature of the beverage in a container or the cold wet periphery, and it is convenient for holding a container. Therefor, it is a very new and practical device; the applicant thereby make the following claims under the protection of the patent law.

I claim:

1. A thermal insulating sheath for covering the side and bottom of a beverage container comprising:

a) a main gasket of thermally insulating material adapted to cover the side of the beverage container and having a generally rectangular configuration with a side edge and opposite end portions;

b) a base gasket of thermally insulating material integrally formed with the main gasket, extending from the side edge and adapted to cover the bottom of the beverage container, the base gasket having a generally circular configuration;

c) at least one tab extending from the base gasket;

d) a plurality of first inter-engaging button snaps attached to the main gasket adjacent to the opposite end portions such that the main gasket can be fastened around the side of the beverage container;

e) at least one second button snap attached to the at least one tab; and, f) at least one third button snap attached to the main gasket adjacent to the side edge such that it may be fastened to the at least one second button snap when the main gasket is fastened around the side of the beverage container such that the base gasket covers the bottom of the beverage container.

* * * * *